US007490709B2

(12) United States Patent
Jönsson

(10) Patent No.: US 7,490,709 B2
(45) Date of Patent: Feb. 17, 2009

(54) COIN DISCRIMINATING DEVICE AND METHOD, AND A COIN HANDLING MACHINE INCLUDING SUCH A DEVICE AND METHOD

(75) Inventor: Manfred Jönsson, Malmö (SE)

(73) Assignee: Scan Coin Industries AB, Malmo (SE)

( * ) Notice: Subject to any disclaimer, the term of this patent is extended or adjusted under 35 U.S.C. 154(b) by 647 days.

(21) Appl. No.: 10/665,129

(22) Filed: Sep. 22, 2003

(65) Prior Publication Data

US 2004/0129527 A1 Jul. 8, 2004

(51) Int. Cl.
*G07D 5/02* (2006.01)

(52) U.S. Cl. ..... 194/335

(58) Field of Classification Search ..... 194/335, 194/334, 302; 73/163
See application file for complete search history.

(56) References Cited

U.S. PATENT DOCUMENTS

| | | | | |
|---|---|---|---|---|
| 3,599,771 | A | 8/1971 | Hinterstocker | |
| 3,788,440 | A | 1/1974 | Propice et al. | |
| 4,184,366 | A * | 1/1980 | Butler | 73/163 |
| 4,360,034 | A | 11/1982 | Davila et al. | |
| 4,361,218 | A | 11/1982 | Van Dort | |
| 4,460,080 | A | 7/1984 | Howard | |
| 4,471,864 | A | 9/1984 | Marshall | |
| 4,556,140 | A | 12/1985 | Okada | |
| 4,717,006 | A | 1/1988 | Chapman et al. | |
| 4,754,862 | A | 7/1988 | Rawicz-Szczerbo et al. | |
| 4,951,800 | A | 8/1990 | Yoshihara | |
| 4,971,187 | A | 11/1990 | Furuya et al. | |
| 5,067,604 | A | 11/1991 | Metcalf | |
| 5,240,099 | A | 8/1993 | Brown et al. | |
| 5,316,120 | A | 5/1994 | Ibarrola | |
| 5,458,225 | A | 10/1995 | Iwamoto et al. | |
| 5,662,205 | A | 9/1997 | Levasseur | |
| 5,687,829 | A * | 11/1997 | Churchman | 194/317 |
| 5,915,518 | A | 6/1999 | Hopwood et al. | |
| 5,988,348 | A | 11/1999 | Martin et al. | |
| 6,039,643 | A | 3/2000 | Kurosawa et al. | |
| 6,047,808 | A | 4/2000 | Neubarth et al. | |

(Continued)

FOREIGN PATENT DOCUMENTS

| | | |
|---|---|---|
| EP | 0 119 000 | 9/1984 |

(Continued)

OTHER PUBLICATIONS

Scan Coin Technical Manual CDS MK 1 Coin Deposit System, 1991, Table of Contents and pp. 13-23.

*Primary Examiner*—Patrick Mackey
*Assistant Examiner*—Mark Beauchaine
(74) *Attorney, Agent, or Firm*—Womble Carlyle Sandridge & Rice, PLLC

(57) ABSTRACT

A coin discriminating device has a sensor electrode and an oscillator. The oscillator is coupled to the sensor electrode. The oscillator generates an output signal with a frequency which is capacitively controllable. A frequency detector detects a frequency deviation in the oscillator output signal, caused by a variation in capacitance at the sensor electrode when a coin is positioned in the vicinity of the sensor electrode. A processing device determines the thickness of the coin from the frequency deviation. The coin discriminating device is arranged such that the variation in capacitance occurs between the sensor electrode and a surface of the coin.

10 Claims, 5 Drawing Sheets

U.S. PATENT DOCUMENTS

| | | | |
|---|---|---|---|
| 6,056,104 | A | 5/2000 | Neubarth et al. |
| 6,196,371 | B1 | 3/2001 | Martin et al. |
| 6,227,343 | B1 | 5/2001 | Neathway et al. |
| 6,298,709 | B1 | 10/2001 | Artzner et al. |
| 6,325,197 | B1 | 12/2001 | Furuya |
| 6,340,082 | B1 | 1/2002 | House et al. |
| 6,398,001 | B1 | 6/2002 | Hutchinson et al. |
| 6,471,030 | B1 | 10/2002 | Neubarth et al. |
| 6,520,308 | B1 | 2/2003 | Martin et al. |
| 6,851,541 | B1 | 2/2005 | Howells |
| 6,988,606 | B2 | 1/2006 | Geib et al. |

FOREIGN PATENT DOCUMENTS

| | | |
|---|---|---|
| EP | 0343871 | 11/1989 |
| EP | 0 364 079 | 4/1990 |
| EP | 0 724 237 | 7/1996 |
| EP | 0 841 641 | 5/1998 |
| EP | 0349114 | 1/1999 |
| EP | 1 020 818 | 7/2000 |
| EP | 1 104 920 | 6/2001 |
| GB | 2 135 095 | 8/1984 |
| GB | 2 160 689 | 12/1985 |
| GB | 2243238 | 10/1991 |
| GB | 2301925 | 12/1996 |
| GB | 2 323 199 | 9/1998 |
| GB | 2 323 200 | 9/1998 |
| GB | 2 357 883 | 7/2001 |
| GB | 2 358 272 | 7/2001 |
| SE | 512 200 | 2/2000 |
| WO | WO 87/07742 | 12/1987 |
| WO | WO 97/07485 | 2/1997 |
| WO | WO 97/25692 | 7/1997 |
| WO | WO 00/25274 | 5/2000 |
| WO | WO 01/29785 | 4/2001 |

* cited by examiner

COIN DISCRIMINATING DEVICE AND METHOD, AND A COIN HANDLING MACHINE INCLUDING SUCH A DEVICE AND METHOD

TECHNICAL FIELD

The present invention relates to a device and a method for coin discrimination or validation. More specifically, the invention relates to coin discrimination or validation by using capacitive coupling between the coin and a sensor device for determining the thickness of the coin. The invention also relates to a coin handling machine, in which the device and method are used.

BACKGROUND ART

Coin discriminators are used for measuring different physical characteristics of a coin in order to determine its type (e.g. its denomination, currency or authenticity). Various dimensional, electric and magnetic characteristics are measured for this purpose, such as the thickness and diameter of the coin, its electric conductivity and its magnetic permeability. Coin discriminators are commonly used in coin handling machines, such as coin counting machines, coin sorting machines, vending machines, gaming machines, etc. Examples of previously known coin handling machines are for instance disclosed in WO97/07485 and WO87/07742.

Starting with the electric characteristics of coins, EP-B-300,781 and EP-B-0,119,000 describe previously known ways of measuring coin conductivity. A transmitter coil is driven with a pulsed supply voltage so as to generate a magnetic pulse, which is induced in a coin, which moves along a coin path or rail past the transmitter coil. The eddy currents thus generated in the coin in turn produce a magnetic field, which is monitored or detected by a receiver coil. The receiver coil may be a separate coil or may alternatively be constituted by the transmitter coil itself having two operating modes. By monitoring the decay of the eddy currents induced in the coin, a value representative of the coin conductivity may be obtained, since the rate of decay is a function thereof. A coin discriminator of a similar type, albeit especially adapted for bimetallic coins, is disclosed in WO99/39311.

As regards the magnetic characteristics of coins, e.g. their magnetic permeability, U.S. Pat. No. 4,483,431 relates to a coin discriminator, where a permanent magnet and a Hall effect device is used for checking the magnetic properties of the coin, when it passes the Hall effect device. Moreover, U.S. Pat. No. 5,119,916 discloses a sensor for validating subway tokens. The sensor has two pairs of permanent magnets and Hall effect sensors, which determine the magnetic characteristics (and consequently the permeability) of the respective token.

Various methods are known for determining the coin diameter in coin discriminators. According to PCT GB88/00592 a coin is exposed to high-frequency magnetic pulses from a pair of coils. When the coin passes the coils, the magnetic field is shielded, and a pickup coil is used for determining the coin diameter in response to this momentary shielding. Alternatively, the coin diameter may be determined optically by using a line of optical detectors located opposite a light source. When a coin passes between the optical detectors and the light source, a certain number of the optical detectors are momentarily shielded or cut off by the passing coin. The coin diameter follows immediately from the number of shielded optical detectors.

Also the coin thickness may be determined by optical arrangements similar to the one described above for measuring the coin diameter. Alternatively, as disclosed in EP-B-300,782, an ultrasound detector may be used for determining the thickness of a coin. Furthermore, EP-A-343,871 discloses a capacitive coin validation method, involving a pair of electrode assemblies on either sides of a coin path. Most specifically, in EP-A-343,871 the pair of electrode assemblies comprises sensor electrodes and guard ring electrodes that are disposed on either sides of the coin path. The sensor electrodes are driven with an oscillating signal from dual resonant circuits, so that when a coin passes the electrodes during the validation thereof, the inter-electrode capacitance is altered. Thus, in effect, the sensor electrodes act as first and second capacitor plates that form a capacitor, the capacitance of which is changed by the presence of the coin. Thereby, also the resonating signals from the resonant circuits are changed. In EP-A-343,871, the coin must be electrically isolated from the electrode assemblies, thereby requiring electrical isolation in the coin path.

Thus, the device in EP-A-343,871 requires an electrically isolated coin path and, moreover, first and second capacitor plates (the electrode assemblies) placed on either side of the coin path.

SUMMARY OF THE INVENTION

It is an object of the present invention to provide an improved coin discriminating device and method for capacitive determination of coin thickness. In particular, the invention seeks to allow such coin discrimination through capacitive determination of coin thickness with less components and improved reliability compared to the prior art.

The objects of the invention are achieved by a coin discriminating device, a coin discriminating method and a coin handling machine according to the attached independent patent claims.

Other objects, features and advantages of the present invention will appear from the following detailed disclosure of a preferred embodiment, from the enclosed drawings as well as from the subclaims.

BRIEF DESCRIPTION OF THE DRAWINGS

A preferred embodiment of the present invention will now be described in more detail, reference being made to the accompanying drawings, in which.

DETAILED DISCLOSURE OF A PREFERRED EMBODIMENT

Figure 1:
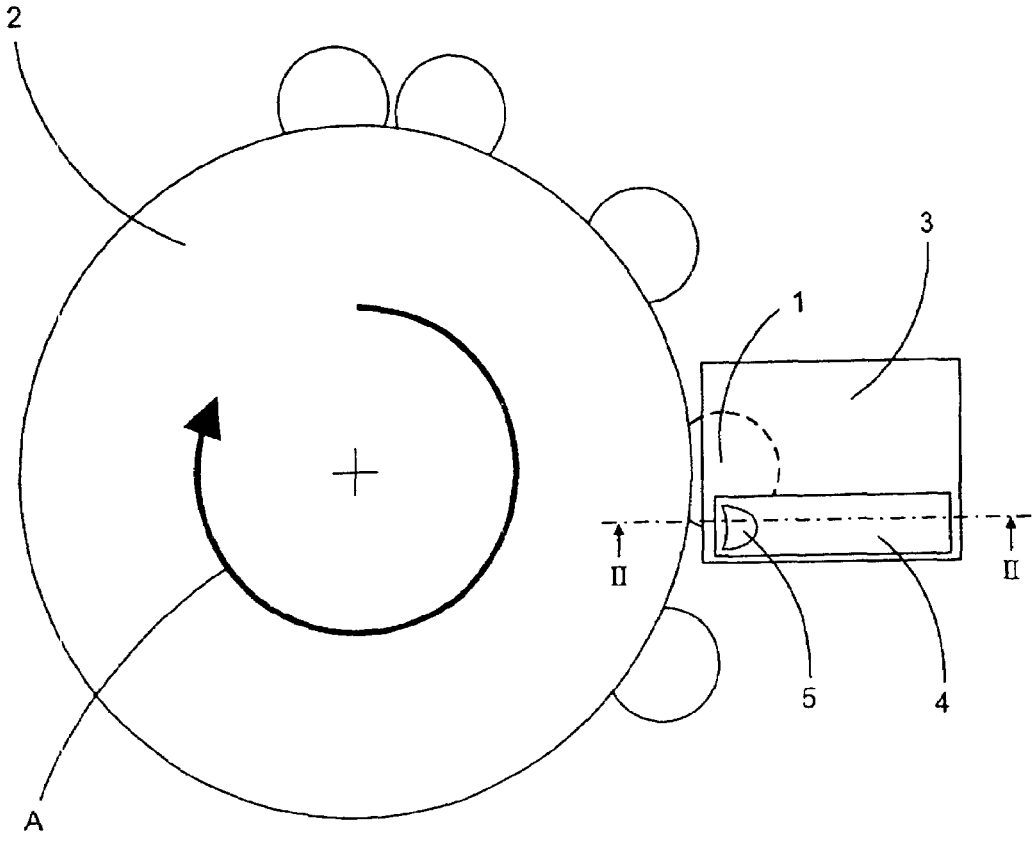
FIG. 1 is a schematic top view of a coin discriminating device according to the invention and a part of a coin transport mechanism.

FIG. 1 illustrates a coin discriminator 3 having a coin discriminating device 4, 5 for determining, by capacitive coupling, the thickness of each individual coin 1 when transported past a sensor electrode 5. FIG. 1 also shows some parts of a coin transport mechanism, which is adapted to transport each coin 1 along a circular path, in a rotational direction A, past the coin discriminator 3 and, specifically, the sensor electrode 5. The coin discriminator 3 and the coin transport mechanism are illustrated in more detail in FIG. 2. As regards the coin transport mechanism, an advantageous implementation is thoroughly described in published PCT applications PCT/SE98/02406 and PCT/SE00/00189, both of which are fully incorporated herein by reference. However, the invention is not limited to this kind of coin transport mechanism.

Briefly, the coin transport mechanism operates as follows. Coins to be discriminated are deposited onto the center region of an essentially flat rotating disc 11. The stationary ring is arranged immediately above the rotating disc 11 with only a minimum gap between the two, without actually reaching contact therewith. A rotating ring 2 is mounted to the outside of the stationary ring. On the underside of the rotating ring 2 there is provided a resilient rim 10. The rotating ring 2 is biased towards the rotating disc 11, so that the resilient rim 10 will frictionally engage the upper surface of the rotating disc 11, thereby forcing the periphery of the rotating disc 11 to rotate at the same speed as the rotating ring 2, when the latter is driven by means of e.g. an electric motor and a drive belt.

As the rotating disc 11 is rotated in direction A, the coins deposited onto the disc are accelerated by the centrifugal force in a radial direction towards the stationary ring. Then, the coins are driven through an opening in the stationary ring and are forced into contact with the inside of the resilient rim 10 on the rotating ring 2. A thin stationary edge or knife is provided on the underside of the stationary ring with a minimum gap to the upper surface of the rotating disc 11. The purpose of the stationary edge or knife is to peel off a single layer of coins, which are engaged between the resilient rim 10 and the rotating disc 11, as illustrated by the coin 1 in FIG. 2. Thus, as shown in FIG. 1, the coins are engaged at their periphery between the resilient rim 10 and the rotating disc 11 and are accurately transported, essentially without friction or other energy losses, along their circular sorting path.

Figure 2:
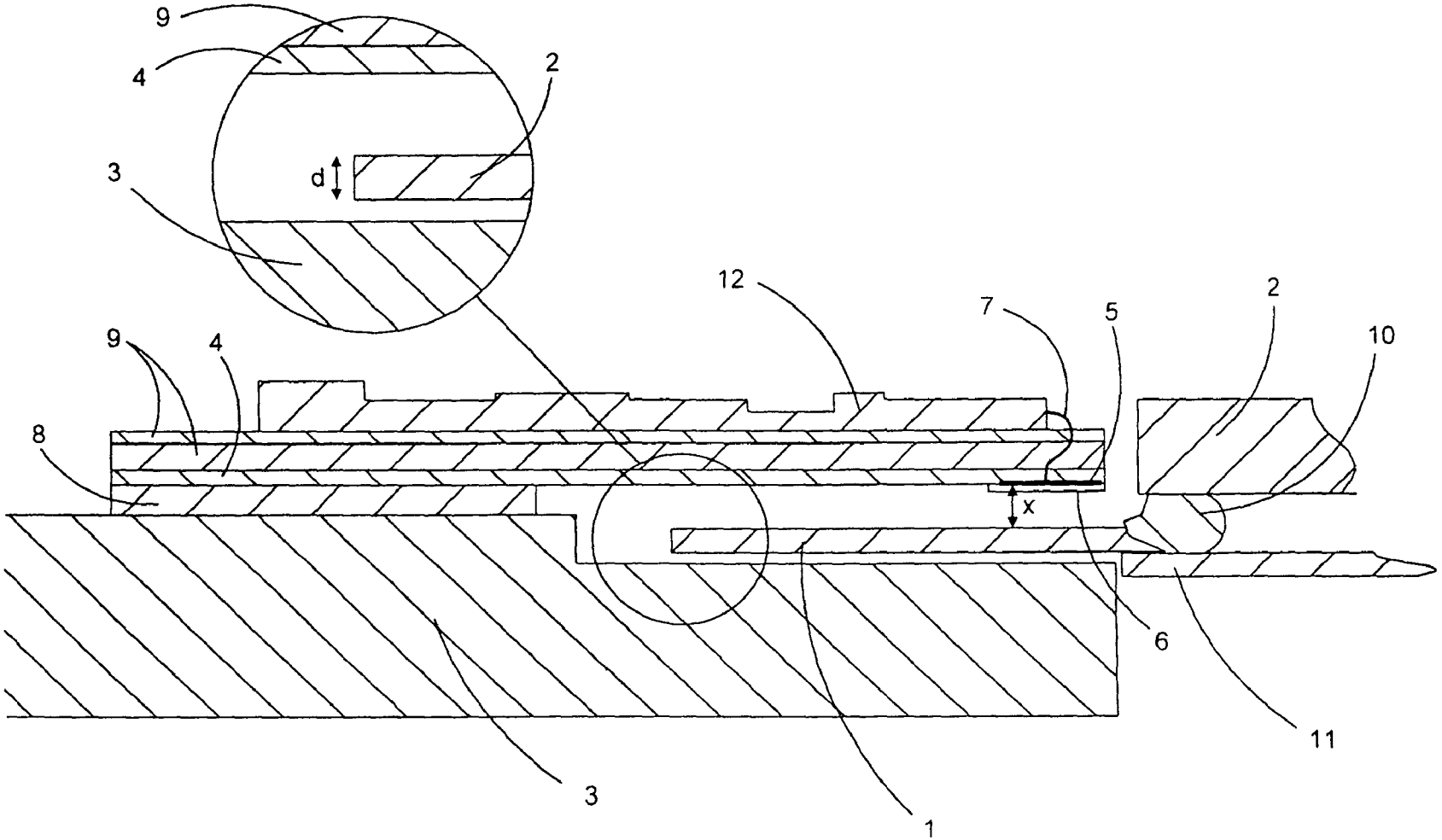
FIG. 2 is an enlarged sectional view of a portion of the device and mechanism shown in FIG. 1.

As already mentioned, the coin discriminator 3 includes a capacitive-type thickness detector, which is indicated at 4 and 5 in FIG. 1 and at 4, 5, 6, 7, 8, 9 and 12 in FIG. 2. In addition, the coin discriminator 3 may advantageously also include further sensors for detecting other properties of the coin 1 than its thickness, such as electrical conductivity, magnetic permeability and diameter. However, such additional sensors are not described further herein.

As shown in FIG. 2, the capacitive-type coin discriminating device (coin thickness detector) is based on a dual-layer circuit board 9 having electronic circuitry 12 mounted thereon. The electronic circuitry is illustrated in more detail in FIG. 3. The circuit board 9 rests on a rigid glass fiber laminate 4, which in turn is attached to a base socket 8 to be securely mounted onto the coin discriminator 3. On its lower surface, the glass fiber laminate layer 4 is provided with the sensor electrode 5, which acts as one capacitor plate, as will be described in more detail in the following, and is electrically coupled, at 7, to the electronic circuitry 12 on top of the circuit board 9. The surface of the sensor electrode 5 is covered by a thin insulating layer 6. As shown in FIG. 2, the coin discriminator 3 and the capacitive coin thickness detector mounted thereon form an intermediate gap, which is large enough for allowing the coin 1 to pass safely in between, without physical contact, when carried along the circular path by the rotating ring 2 and the rotating disc 11.

Figure 3:
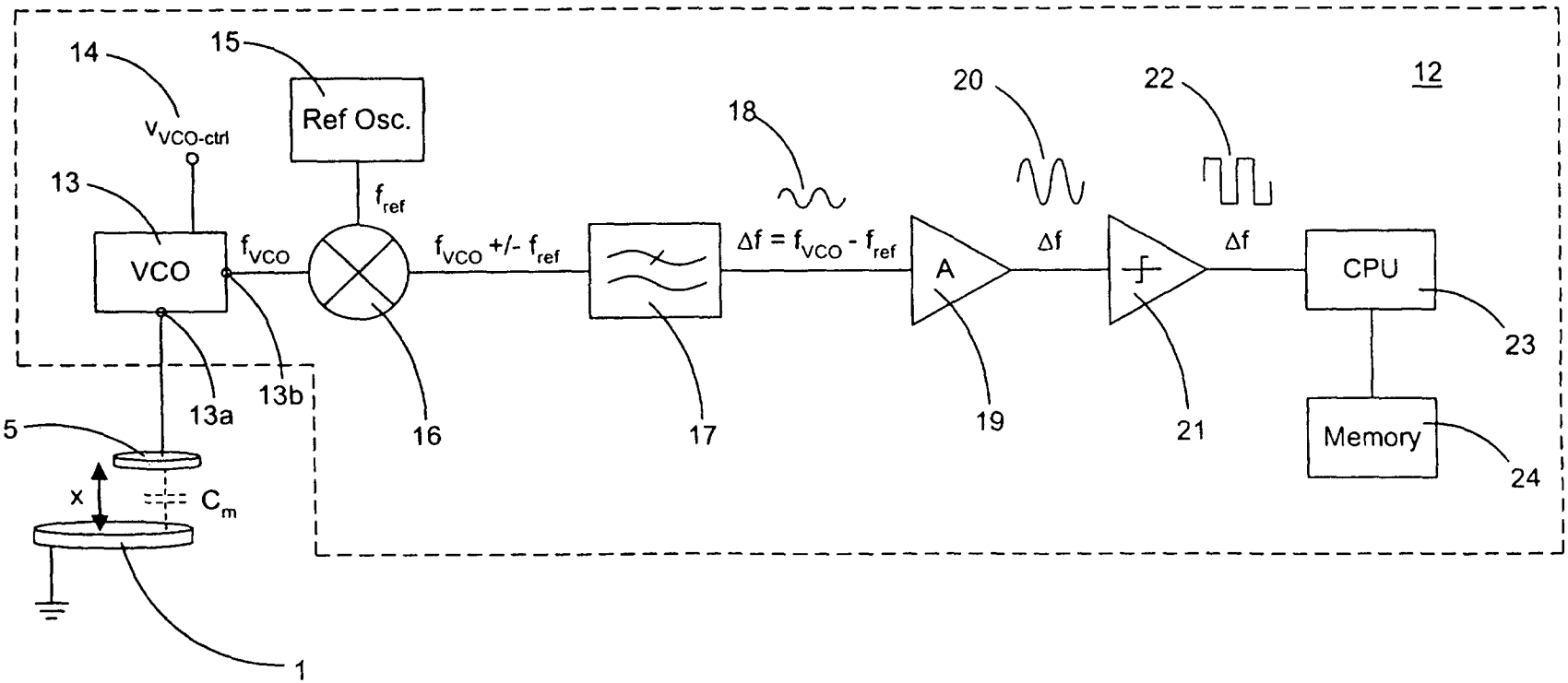
FIG. 3 is a schematic block diagram of a preferred embodiment of the coin discriminating device.

The general principle of the coin discriminating device according to the invention is that there exists a relation between the position of the upper surface of the coin 1 and the thickness of the coin 1. To this end, the position of the upper coin surface is measured by the sensor electrode 5, in the form of a distance x, through a capacitance $C_m$, which is generated between the upper surface of the coin 1 and the sensor electrode 5. Thus, the sensor electrode 5 will act as a first capacitor plate, whereas the upper surface of the coin 1 will act as a second capacitor plate. Since the lower surface of the coin 1 will always be in the same position in relation to the sensor electrode 5 (thanks to the fixed arrangement of the coin transport mechanism 2, 10, 11), it is possible to determine the thickness of the coin. With reference to FIG. 3, the capacitance $C_m$ between the sensor electrode 5 and the upper surface of the coin 1 is determined by the electronic circuitry 12 in the following way.

A voltage-controlled oscillator (VCO) 13 is used as a first signal-producing element. To pre-set the frequency operating range of the VCO 13 a voltage-variable reactance is used, such as a BB804 VHF variable capacitance double diode from Philips Semiconductors, Marketing & Sales Communications, Building BE-p, P.O. Box 218, 5600 MD Eind-hoven, The Netherlands. However, any suitable tuning diode might be used. When the tuning diode is used in the resonant circuit of the VCO 13, the capacitance of the diode together with the rest of the elements in the resonant circuit will form a total reactance, which matches the frequency of the desired VCO 13 output signal. The frequency operating range of the VCO 13 is then adjusted by applying a control voltage $V_{VCO\text{-}ctrl}$ at a VCO control terminal 14.

However, the frequency of the VCO 13 is not only determined by the tuning diode and the control voltage. The capacitance $C_m$, which is formed by the sensor electrode 5 and the coin 1, is coupled to the resonant circuit of the VCO 13 and thus affects its output frequency. As is well known, the capacitance value of a capacitor is a function of the distance between the capacitor plates. Therefore, the capacitance will increase as the distance between the plates decreases. Consequently, since the lower surface of the coin 1 is at a fixed distance from the sensor electrode 5, the distance x between the upper side of the coin 1 and the sensor 5 will vary depending on the thickness d of the coin. This will result in that the output frequency of the VCO 13 will vary as a function of the thickness of the tested coins.

The output frequency of the VCO 13, $f_{VCO}$, is then compared with the frequency of a fixed reference oscillator 15, $f_{ref}$, such as a SG8002CA programmable high frequency crystal oscillator from EPSON Electronics America Inc., 150 River Oaks Parkway, San Jose, Calif. 95134. The above-mentioned oscillator is by no means the only suitable oscillator for this invention. Since it is important that the reference oscillator 15 is frequency stable, a crystal oscillator is preferably used as reference oscillator 15. Through the rapid development of semiconductor technology, numerous semiconductor manufacturers provide high quality oscillators at reasonable prices.

The comparison between the output frequency of the VCO 13, $f_{VCO}$, and the reference oscillator 15, $f_{ref}$, is carried out by a mixer 16, such as a SA602A from Philips Semiconductors, which produces the sum and difference of the two frequencies, $f_{VCO}+/-f_{ref}$. The theory of operation of a mixer is well known to those skilled in the art and is thoroughly described in the literature, for instance in chapter 7-2 of "Electric Communication Techniques", by Paul H. Young, Macmillan Publishing Company, 113 Sylvan Avenue, Englewood Cliffs, N.J. 07632, ISBN 0-02-431201-0.

To be able to separate the various frequency components being the result of the mixing operation, the mixer output signal passes through a low pass filter 17, which at its output will provide a signal 18 with the frequency $\Delta f=f_{VCO}-f_{ref}$.

This signal 18 is then amplified by an amplifier 19, which may be built from discrete components. The preferred embodiment uses the well known common emitter (CE) amplifier topology, based on a single transistor such as a BC817 from Philips Semiconductors. However, many different amplifier topologies may be used for this amplifier, such as differential amplifier topology or bootstrap amplifier topology, as is well known to a person skilled in the art. Alternatively, an operational amplifier may be used as long as the maximum frequency that the operational amplifier can handle is greater than the bandwidth of the output signal of the low pass filter 17.

Since the amplifier 19 is a linear element, the output signal 20 from the amplifier 19 is a signal 20 with the same frequency, Δf, as the input signal 18 but with larger amplitude. The signal 20 is then transformed by a zero crossing detector 21 into a square wave 22 with the same fundamental frequency as the amplifier output signal 20. The zero crossing detector 21 may be made up from a Schmitt trigger circuit, such as a 74HC14 from Philips Semiconductors, among others, or alternatively from an ordinary comparator circuitry which is thoroughly described in for instance chapter 6 of "Operational Amplifiers with linear Integrated Circuits", by William D. Stanley, Prentice Hall, Inc, Englewood Cliffs, N.J. 07632, ISBN 0-02-415556-X. The main task of the zero crossing detector 21 is to act as an interface circuit between the amplifier and a CPU 23.

The CPU used in the preferred embodiment of the invention is part of the C166 family from Infineon Technologies Corp., 1730 North First St., USA-San Jose, Calif. 95112. However other suitable processors may be used. The CPU 23 has an associated memory 24, preferably a nonvolatile memory such as a PROM, EPROM, EEPROM or flash memory. The memory 24 stores various calibration, normalization and coin reference data, which are needed in order to determine a thickness of the coin 1 from the deviation Δf from the idle frequency $f_{VCO}$ of the VCO 13. As already explained, the frequency deviation Δf is a function of the capacitance $C_m$, which in turn depends on the distance x between the sensor electrode 5 and the upper surface of the coin 1 and, thus, the thickness of the coin 1. To this end, the memory 24 stores coin reference data which provide a mapping between frequency deviations Δf and coin thickness in e.g. mm.

Figure 4:
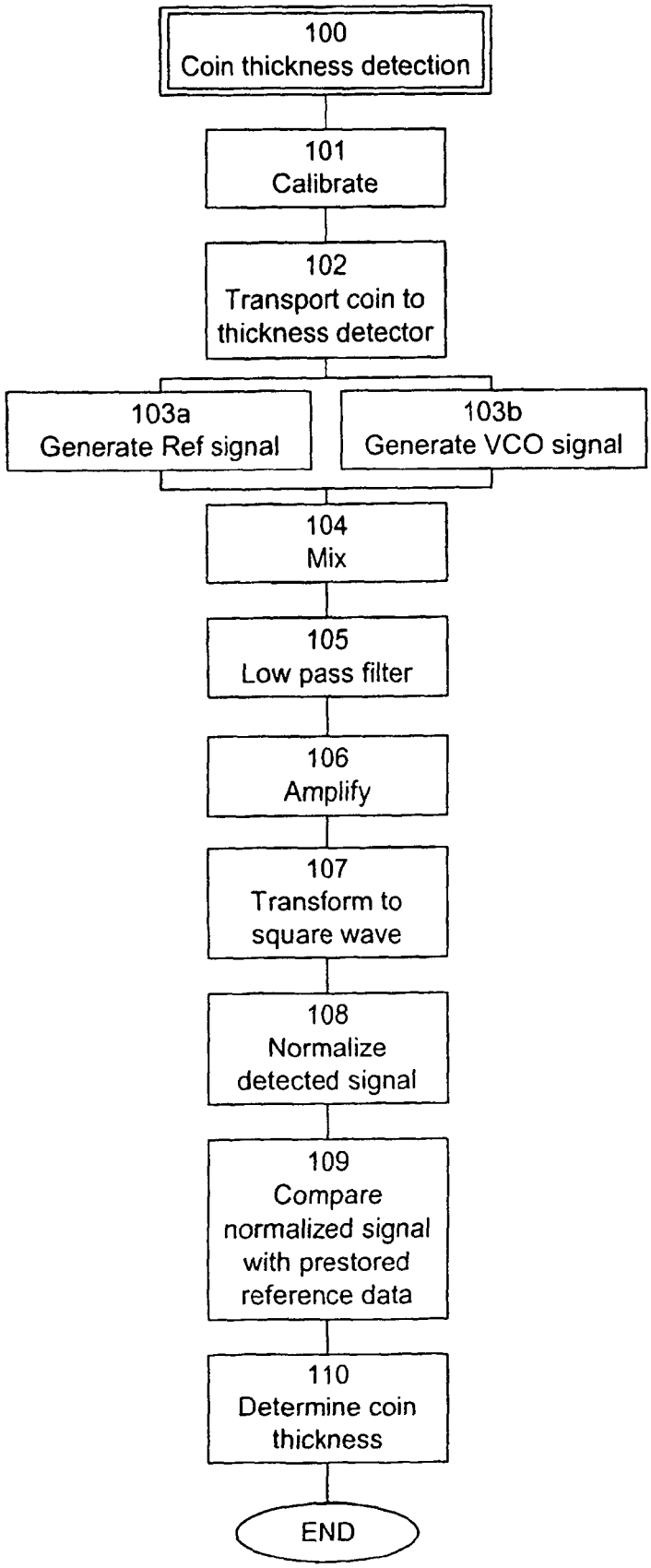
FIG. 4 is a flowchart diagram illustrating a coin discriminating method according to the preferred embodiment.

An outline of the operational steps of the coin thickness detector described in the previous drawings is given in the form of a coin thickness detection procedure 100 in FIG. 4. In a first step 101, the coin thickness detector may be calibrated, by making use of prestored calibration data in the memory 24, so as to compensate for differences in temperature, etc. Step 102 represents the transport of the coin 1 by the coin transport mechanism 2, 10, 11 to the measurement position in alignment with the sensor electrode 5. The reference signal $f_{ref}$ from the reference oscillator 15 is generated in a step 103*a*, and, simultaneously, the output signal $f_{VCO}$ from the VCO 13 is generated in a step 103*b*. The two signals are mixed by the mixer 16 in a step 104, and the result thereof is filtered and amplified, by components 17 and 19, respectively, in steps 105 and 106. Then, the Schmitt trigger 21 transforms the output signal 20 from the amplifier 19 into the square wave signal 22 having, still, the fundamental frequency Δf. In steps 108-110 the CPU 23 normalizes the signal 22 and compares the normalized signal with the prestored reference data in memory 24 so as to finally determine the thickness of the coin 1 in step 110. The determined thickness value is reported to the coin discriminator 3, which may use the determined thickness value in combination with other coin parameters so as to determine a type of the coin 1. As is well known per se, a coin type in this respect may relate to denomination, currency, authenticity, etc.

Figure 5:
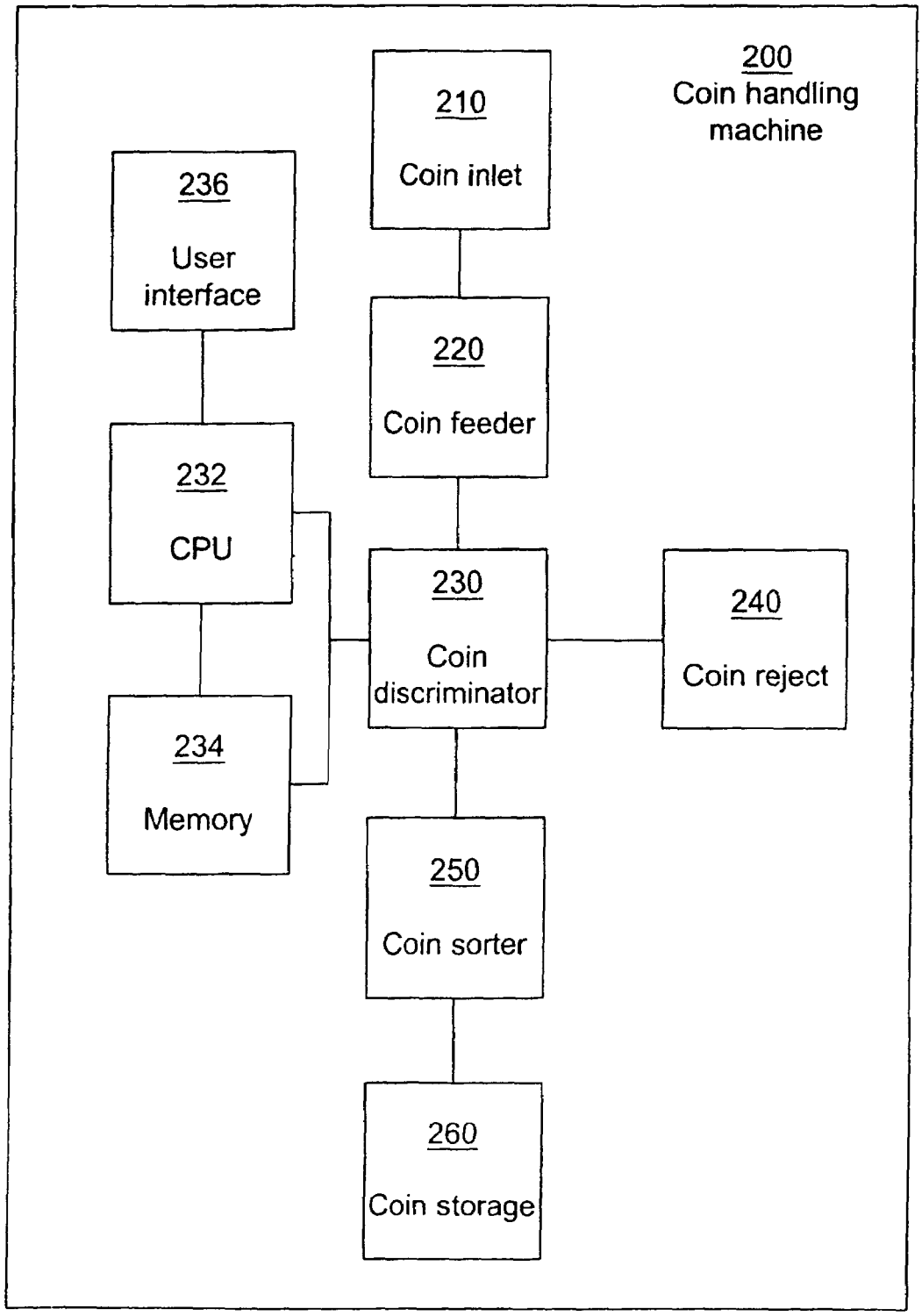
FIG. 5 is a schematic block diagram of a coin handling machine according to the invention.

Referring now to FIG. 5, a coin handling machine 200 is illustrated according to one aspect of the present invention. In an exemplifying but non-limiting sense, the coin handling machine 200 is assumed to be a coin sorter. However, the coin handling machine 200 may equally well be a coin counter, a vending machine, a gaming machine, an automatic teller machine (ATM), a machine for testing coin quality or for identifying counterfeit coins, etc.

A mass of coins to be sorted by the machine 200 are deposited into a coin inlet 210. The coins are fed by a coin feeder 220, such as a hopper and/or an endless belt, to the coin discriminator 230, which has been described above under reference numerals 3-9 and 12 with reference to FIGS. 1-4. The coin discriminator 230 is operatively connected to a logic controller device 232 in the form of a CPU or the like, which is operatively connected to a memory 234, such as a RAM, ROM, EEPROM and/or flash memory. The CPU 232 and memory 234 are responsible for the overall operation of the coin handling machine 200 but may also implement some of the functionality of the coin discriminatcor 3-9, 12.

The coin handling machine 200 also comprises a coin reject device 240, which delivers rejected coins through an external opening in the machine 200, so that these coin may be collected by a user of the machine. As described above, rejected coins are determined through the coin discriminator. Once the type, denomination, currency, identity, authenticity, etc, of the coin 1 has been determined by the coin discriminator, the coin 1 is passed to a coin sorter 250, which uses the identified coin type to sort the coin 1 into one specific coin receptacle in a coin storage 260. The coin receptacles in the coin storage 260 are preferably externally accessible for the user of the machine 200.

In an alternative embodiment, the coin discriminator 3 may advantageously be provided with a second sensor electrode, which is mounted on the opposite side of the coin surface 1, i.e. below the coin 1 in the drawings. Additionally, this second sensor electrode 6 is coupled to its own instance of the electronic circuitry 12, so that the sensor electrodes 5 and 6 independently of each other, in conjunction with their respective electronic circuitry 12, may produce a value of the distance x between the first sensor electrode 5 and the upper coin surface, and a corresponding distance between the second sensor electrode and the lower surface of the coin 1. This will allow an accurate determination of coin thickness, even in a situation where the coin is not perfectly horizontally aligned with the first and second sensor electrodes.

In yet an alternative embodiment, the coin discriminator 3, 230 may use the capacitive-type coin coin thickness detector in conjunction with another detected coin parameter, such as coin conductivity or permeability, so as to detect the presence of a non-coin object, made of for instance plastics. It has been observed by the present inventor that even a non-metallic object will cause a detectable frequency deviation Δf, which may be used as an indication that a non-coin object is present in front of the coin discriminator 3, since, in this situation, the other coin parameter (e.g. conductivity or permeability) will not indicate any presence of an object at all, provided that such object is non-metallic. Once the presence of such a non-coin object has been detected, the object may be rejected through the coin reject device 240.

The invention has been described above with reference to a few embodiment examples. However, other embodiments than the ones described above are possible within the scope of the invention, as defined by the appended independent patent claims.

In particular, it is emphasized that the different exemplary components of the coin discriminator of FIGS. 1-4 as well as the components of the coin handling machine 200 of FIG. 5 are only to be regarded as examples and may be substituted by other components, as is readily realized by a man skilled in the art of coin discrimination and processing.

Finally, the term "coin" is to be interpreted as having the widest possible meaning. Thus, objects similar to monitary coins are intended to fall under the term "coin" used in this patent application. Such other objects include for instance tokens, markers, etc.

The invention claimed is:

1. A coin discriminating device, comprising a sensor electrode;

an oscillator coupled to the sensor electrode, the oscillator being capable of generating an output signal with a frequency which is capacitively controllable;

a capacitor for controlling the output signal, the capacitor comprising a first capacitor plate and a second capacitor plate for generating a capacitance therebetween, the first capacitor plate comprising the sensor electrode and the second capacitor plate comprising a coin positioned in a vicinity of the sensor electrode, the capacitor being free of a third capacitor plate coupled to the oscillator;

a frequency detector for receiving the output signal from the oscillator as well as a reference signal from a reference oscillator so as to provide an output which comprises a difference between the output signal and the reference signal for detecting a frequency deviation in the oscillator output signal, caused by a variation in capacitance at the sensor electrode when the coin is positioned in a vicinity of the sensor electrode; and a processing device for determining a thickness of the coin from the frequency deviation, wherein the coin discriminating device is arranged such that the variation in capacitance occurs in a gap between the sensor electrode and a surface of the coin, wherein the size of the gap depends on the thickness of the coin.

2. The coin discriminating device according to claim 1, wherein the oscillator comprises a voltage-controlled oscillator.

3. The coin discriminating device of claim 1 wherein the second capacitor plate is electrically connected to ground.

4. The coin discriminating device of claim 1 wherein the capacitance is based solely on the gap between the first and second capacitor plate and is not based on any intervening structure between the first and second capacitor plate.

5. A coin handling machine, comprising:

a coin inlet;

a coin feeder;

a coin discriminator;

a handling device; wherein the coin discriminator is coupled to the handling device and is for determining a type, identity or denomination of respective coins received from the coin feeder;

wherein the coin discriminator comprises:

a sensor device capable of measuring a variation in capacitance between a sensor electrode and a surface of an individual coin positioned in a vicinity of the sensor electrode, the sensor device comprising a capacitor having a first capacitor plate and a second capacitor plate for generating a capacitance therebetween, the first capacitor plate comprising the sensor electrode and the second capacitor plate comprising the coin positioned in the vicinity of the sensor electrode, the capacitor being free of a third capacitor plate coupled to the oscillator wherein the variation in capacitance occurs in a gap between the sensor electrode and a surface of the coin, a size of the gap depending on a thickness of the coin;

a signal generating device capable of producing a signal representing the variation in capacitance; and a processing device capable of determining a thickness of the coin from the signal.

6. The coin handling machine of claim 5 wherein the second capacitor plate is electrically connected to ground.

7. The coin handling device of claim 5 wherein the capacitance is based solely on the gap between the first and second capacitor plate and is not based on any intervening structure between the first and second capacitor plate.

8. A coin discriminating device for determining a thickness of a coin, the coin discriminating device comprising a sensor electrode;

an oscillator electrically connected to the sensor electrode, the oscillator generating an output signal having a frequency that is capacitively controllable;

a frequency detector for receiving the output signal from the oscillator as well as a reference signal from a reference oscillator so as to provide an output which comprises a difference between the output signal and the reference signal and is for detecting a frequency deviation in the oscillator output signal, the frequency deviation being caused by a variation in capacitance at the sensor electrode when the coin is positioned in a vicinity of the sensor electrode and electrically connected to ground; and a processing device for determining a thickness of the coin from the frequency deviation, wherein the coin discriminating device is arranged such that a variation in capacitance occurs in a gap between the sensor electrode and a surface of the coin, wherein the size of the gap depends on the thickness of the coin.

9. The coin discriminating device of claim 8 further comprising a capacitor for controlling the output signal, the capacitor comprising a first capacitor plate and a second capacitor plate for generating a capacitance therebetween, the first capacitor plate comprising the sensor electrode and the second capacitor plate comprising the coin.

10. The coin discriminating device of claim 9 wherein the capacitance is based solely on the gap between the first and second capacitor plate and is not based on any intervening structure between the first and second capacitor plate.

* * * * *

UNITED STATES PATENT AND TRADEMARK OFFICE

CERTIFICATE OF CORRECTION

PATENT NO. : 7,490,709 B2
APPLICATION NO. : 10/665129
DATED : February 17, 2009
INVENTOR(S) : Manfred Jonsson It is certified that error appears in the above-identified patent and that said Letters Patent is hereby corrected as shown below:

Col. 1, line 5, the following text should be inserted:

--Cross-Reference to Related Applications

This application is a continuation of international application no. PCT/SE02/00551, filed on March 20, 2002, and designating the United States of America; which application claims the benefit of Swedish patent application no. 0101047-9, filed on March 22, 2001.--

Signed and Sealed this
Thirtieth Day of August, 2011

David J. Kappos

David J. Kappos
*Director of the United States Patent and Trademark Office*